US010538863B2

(12) United States Patent
Ito et al.

(10) Patent No.: US 10,538,863 B2
(45) **Date of Patent: *Jan. 21, 2020**

(54) CLOTH HAVING EXCELLENT CONTACT COLD SENSATION AND COLORFASTNESS

(71) Applicant: MITSUBISHI GAS CHEMICAL COMPANY, INC., Tokyo (JP)

(72) Inventors: Akira Ito, Tokyo (JP); Daisuke Sunaga, Mie (JP); Kohsuke Togashi, Ishikawa (JP)

(73) Assignee: MITSUBISHI GAS CHEMICAL COMPANY, INC., Tokyo (JP)

( * ) Notice: Subject to any disclaimer, the term of this patent is extended or adjusted under 35 U.S.C. 154(b) by 52 days.

This patent is subject to a terminal disclaimer.

(21) Appl. No.: 15/759,371

(22) PCT Filed: Sep. 7, 2016

(86) PCT No.: PCT/JP2016/076232

§ 371 (c)(1),
(2) Date: Mar. 12, 2018

(87) PCT Pub. No.: WO2017/047459

PCT Pub. Date: Mar. 23, 2017

(65) Prior Publication Data

US 2018/0179670 A1 Jun. 28, 2018

(30) Foreign Application Priority Data

Sep. 18, 2015 (JP) ..... 2015-184624

(51) Int. Cl.

| | |
|---|---|
| ***D04B 1/16*** | (2006.01) |
| ***D01F 6/66*** | (2006.01) |
| ***D06M 15/39*** | (2006.01) |
| *D01F 8/16* | (2006.01) |
| *D06M 101/20* | (2006.01) |
| *D06M 101/24* | (2006.01) |
| *D06M 101/32* | (2006.01) |

(52) U.S. Cl.

CPC ..... *D01F 6/66* (2013.01); *D06M 15/39* (2013.01); *D01F 8/16* (2013.01); *D06M 2101/20* (2013.01); *D06M 2101/24* (2013.01); *D06M 2101/32* (2013.01); *D10B 2401/02* (2013.01); *D10B 2501/00* (2013.01); *D10B 2503/06* (2013.01); *D10B 2505/12* (2013.01)

(58) Field of Classification Search

USPC ..... 428/373

See application file for complete search history.

(56) References Cited

U.S. PATENT DOCUMENTS

| | | | |
|---|---|---|---|
| 2003/0129391 | A1 | 7/2003 | Okawa |
| 2010/0190406 | A1 | 7/2010 | Usui et al. |
| 2015/0225536 | A1 | 8/2015 | Ito |
| 2018/0266018 | A1* | 9/2018 | Ito ..... C08L 59/04 |

FOREIGN PATENT DOCUMENTS

| | | |
|---|---|---|
| JP | 43-6101 | 3/1943 |
| JP | 8-144128 | 6/1996 |
| JP | 2002-235278 | 8/2002 |
| JP | 2003-183943 | 7/2003 |
| JP | 2003-268627 | 9/2003 |
| JP | 2004-360146 | 12/2004 |
| JP | 2005-013829 | 1/2005 |
| JP | 2006-009205 A | 12/2006 |
| JP | 2008-163505 | 7/2008 |
| WO | 2014/050448 | 4/2014 |
| WO | 2016/147998 | 9/2016 |

OTHER PUBLICATIONS

Extended European Search Report issued in the counterpart European Patent Application No. 16846331.3 dated Sep. 10, 2018.
International Search Report issued in International Bureau of WIPO Patent Application No. PCT/JP2016/076232, dated Dec. 6, 2016.
Extended European Search Report issued in the counterpart European Patent Application No. 16846330.5 dated Sep. 10, 2018.

* cited by examiner

*Primary Examiner* — Terressa Boykin
(74) *Attorney, Agent, or Firm* — Greenblum & Bernstein, P.L.C.

(57) ABSTRACT

A cloth containing a fiber having on a surface a polyacetal copolymer containing a prescribed amount of oxyalkylene unit(s), wherein the cloth exhibits a $q_{max}$ value of at least 0.2 W/cm$^2$, when the cloth is brought into contact with a heat storing plate of 40° C. under a contact pressure of 0.098 N/cm$^2$ in an environment at a temperature of 20° C. and at a relative humidity of 65%, is superior in contact cold sensation, colorfastness, quick drying property and gloss.

10 Claims, No Drawings

CLOTH HAVING EXCELLENT CONTACT COLD SENSATION AND COLORFASTNESS

TECHNICAL FIELD

The present invention relates to a cloth having excellent contact cold sensation and excellent colorfastness, which is formed from a fiber having a polyacetal copolymer on the surface, and a clothing article, a bedding article, an interior article, or an interior automotive trim using the cloth.

BACKGROUND ART

Polyacetal is an engineering plastic which is excellent in mechanical physical properties, heat resistance, chemical resistance, and electrical properties, and has been widely used in the fields of, for example, electric devices, automobiles, machines, and building materials. Further, polyacetal can be formed into fibers, and therefore is being applied to the use as industrial materials, such as a brush and a filter, for which the mechanical strength, heat resistance, and chemical resistance that are advantageous properties of the polyacetal can be utilized (see, for example, Patent Literatures 1 to 3, and Non Patent Literature 1).

Recently, with respect to the material for underclothes for summer and sheets for bedclothes, studies have been made on a cloth having excellent contact cold sensation, which causes skins to feel cool when wearing or touching the cloth, giving them a sensation of coolness. For example, a cloth using a general material for cloth such as cotton and polyester fibers, e.g., PET, is disadvantageous in that fabric of the cloth itself exhibits only unsatisfactory contact cold sensation. Therefore, for the purpose of achieving the cloth having excellent contact cold sensation, there have been proposed a method in which an improved water absorption property is imparted to the fiber constituting the cloth, and a method in which an improved thermal conductivity is imparted to the fiber (see, for example, Patent Literature 4).

CITATION LIST

Patent Literature

Patent Literature 1: JP 2008-163505 A
Patent Literature 2: JP 2004-360146 A
Patent Literature 3: JP 2005-13829 A
Patent Literature 4: JP 2002-235278 A

Non Patent Literature

Non Patent Literature 1: Hidetoshi Ookawa, DURACON (registered trademark) Fiber, Sen'i Gakkaishi (Fibers and Industries), vol. 65, No. 4 (2009), pp. 22-25

SUMMARY OF INVENTION

Technical Problem

With respect to the cloth having an improved water absorption property for the purpose of improving the contact cold sensation, there can be mentioned, for example, a cloth which uses a fiber comprising a resin to which a hydrophilic group such as a carboxyl group or a hydroxyl group is introduced. Further, with respect to the cloth having an improved thermal conductivity, there can be mentioned, for example, a cloth which uses a fiber comprising a resin into which a filler having a high thermal conductivity is incorporated by kneading, and a cloth which uses a fiber having a plated surface. The cloth using the above-mentioned fibers is theoretically expected to have contact cold sensation; however, in an actual functional test conducted in humans, the feeling of the cloth is almost the same as that of a cloth of untreated fiber, and the contact cold sensation of the cloth cannot be actually felt.

Further, Patent Literature 4 discloses a cloth comprising a fiber having a contact cold sensation function, which is a fiber on which porous inorganic powder particles containing a water absorbing polymer therein are supported. This cloth has a contact cold sensation at such a level that the coolness can be actually felt. However, for obtaining a satisfactory contact cold sensation, it is necessary that the cloth contain a large amount of the porous inorganic powder particles, so that an adverse effect is caused on the texture or feel of the cloth, making it impossible to use the cloth in, for example, underclothes and sheets for bedclothes.

On the other hand, products obtained from a fiber of polyacetal are mainly used in the commercial application and industrial application in which the conventionally known properties of the polyacetal, such as mechanical properties, sliding properties, a heat resistance, and a chemical resistance, are utilized. There has not been known any cloth comprising polyacetal and having excellent contact cold sensation, which can be used in, for example, underclothes and sheets for bedclothes.

The present invention has been made in view of the above problems, and an object of the present invention is to provide a cloth having excellent contact cold sensation and excellent colorfastness even when it is used as a fabric. Further, an object of the present invention is to provide a cloth having excellent quick drying property and gloss. Such a cloth can be suitably used as cloth products which are required to have contact cold sensation, excellent feel, and quick drying property, e.g., clothing articles, such as underwear (underclothes) and outerwear (e.g., sportswear), bedding articles, such as a sheet, a bedding quilt (futon) cover, and a pillow cover, interior articles, such as a curtain, and interior automotive trims.

Solution to Problem

The present inventors have conducted extensive studies in order to achieve the above-mentioned objects. As a result, they have found that a cloth which comprises a fiber having on a surface a polyacetal copolymer containing oxyalkylene unit(s) in a specific amount, and which exhibits a $q_{max}$ value of at least 0.2 W/cm$^2$ when the cloth is brought into contact with a heat storing plate of 40° C. under a contact pressure of 0.098 N/cm$^2$ in an environment at a temperature of 20° C. and at a relative humidity of 65% has excellent contact cold sensation and excellent colorfastness when the cloth is used as fabric. Further, it has been found that the above-mentioned cloth has excellent quick drying property and excellent gloss, and the present invention has been completed.

Specifically, the present invention is as follows.

(1) A cloth comprising a fiber having on a surface a polyacetal copolymer (X) comprising oxymethylene unit(s) and oxyalkylene unit(s) represented by the general formula (1) below, wherein the polyacetal copolymer (X) contains 0.2 to 5.0% by mole of the oxyalkylene unit(s), based on total moles of the oxymethylene unit(s) and oxyalkylene unit(s), and wherein the cloth exhibits a $q_{max}$ value of at least 0.2 W/cm$^2$, in which the $q_{max}$ value indicates a maximum in a heat flux curve obtained by plotting, relative to time t, a heat flux q (t) per unit area which transfers from a heat storing plate of 40° C. to the cloth, when the cloth is brought into contact with the heat storing plate under a contact pressure of 0.098 N/cm$^2$ in an environment at a temperature of 20° C. and at a relative humidity of 65%:

[Chemical formula 1]

(1)

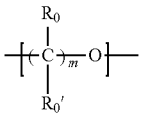

wherein each of $R_0$ and $R_0'$ represents a hydrogen atom, an alkyl group having 1 to 8 carbon atoms, an organic group having an alkyl group having 1 to 8 carbon atoms, a phenyl group, or an organic group having a phenyl group, and a plurality of $R_0$'s and $R_0$'s are the same or different, and m represents an integer of 2 to 6.

(2) The cloth according to item (1) above, wherein the polyacetal copolymer (X) has a degree of orientation of molecular chains of 75 to 95%.

(3) The cloth according to item (1) or (2) above, wherein the fiber having on a surface a polyacetal copolymer (X) is a single-layer fiber of the polyacetal copolymer (X).

(4) The cloth according to item (1) or (2) above, wherein the fiber having on a surface a polyacetal copolymer (X) is a multilayer fiber, in which a fiber comprising a thermoplastic resin is coated with the polyacetal copolymer (X).

(5) The cloth according to item (1) or (2) above, wherein the fiber having on a surface a polyacetal copolymer (X) is a composite fiber having the polyacetal copolymer (X) on the surface of a fiber comprising a thermoplastic resin.

(6) The cloth according to item (4) or (5) above, wherein the thermoplastic resin is at least one member selected from a polyacetal homopolymer, a polyacetal copolymer other than the polyacetal copolymer (X), a polyolefin resin, a polylactic acid resin, a nylon resin, a polyester resin, a polyvinyl resin, and an elastomer thereof.

(7) A clothing article from the cloth according to any one of items (1) to (6) above.

(8) A bedding article from the cloth according to any one of items (1) to (6) above.

(9) An interior article from the cloth according to any one of items (1) to (6) above.

(10) An interior automotive trim from the cloth according to any one of items (1) to (6) above.

Advantageous Effects of Invention

By the present invention, a cloth having excellent contact cold sensation and excellent colorfastness even when it is used as fabric can be provided. Further, a cloth having excellent quick drying property and excellent gloss as well as excellent contact cold sensation and colorfastness can be provided. Furthermore, the cloth of the present invention has excellent contact cold sensation, quick drying property, gloss, and colorfastness, and therefore there can be provided cloth products having excellent texture and feel, such as a clothing article, a bedding article, an interior article, and an interior automotive trim.

DESCRIPTION OF EMBODIMENTS

<Cloth Having Excellent Contact Cold Sensation and Colorfastness>

Hereinbelow, the present invention will be described in detail. The present invention is directed to a cloth which comprises a fiber having on a surface a polyacetal copolymer (X) comprising oxymethylene unit(s) and oxyalkylene unit(s) represented by the general formula (1) shown below, wherein the polyacetal copolymer (X) contains 0.2 to 5.0% by mole of the oxyalkylene unit(s), based on total moles of the oxymethylene unit(s) and oxyalkylene unit(s), and wherein the cloth exhibits a $q_{max}$ value of at least 0.2 W/cm$^2$, in which the $q_{max}$ value indicates a maximum in a heat flux curve obtained by plotting, relative to time t, a heat flux q (t) per unit area which transfers from a heat storing plate of 40° C. to the cloth, when the cloth is brought into contact with the heat storing plate under a contact pressure of 0.098 N/cm$^2$ in an environment at a temperature of 20° C. and at a relative humidity of 65%. Such a cloth has excellent contact cold sensation and excellent colorfastness.

<Fiber Constituting the Cloth of the Present Invention>

The cloth of the present invention having excellent contact cold sensation and colorfastness comprises, as a fiber constituting the cloth, a fiber having on a surface polyacetal copolymer (X) containing an oxymethylene unit(s) and an oxyalkylene unit(s) represented by the general formula (I) shown below, wherein the content of the oxyalkylene unit(s) in polyacetal copolymer (X) is 0.2 to 5.0% by mole, based on total moles of the oxymethylene unit(s) and oxyalkylene unit(s).

As mentioned above, in the cloth of the present invention, as a fiber constituting the cloth, the above-mentioned fiber having on the surface polyacetal copolymer (X) containing oxyalkylene unit(s) in a specific amount is used. The form of the fiber having polyacetal copolymer (X) on the surface is not particularly limited, but is preferably [A] a form of a single-layer fiber of polyacetal copolymer (X), [B] a form of a multilayer fiber having a surface coated with polyacetal copolymer (X), or [C] a form of a composite fiber having a surface of a fiber comprising a thermoplastic resin on which polyacetal copolymer (X) is exposed.

The form of a single-layer fiber of the above-mentioned form [A] of polyacetal copolymer (X) is a fiber comprising polyacetal copolymer (X). The single-layer fiber can be obtained by melt spinning polyacetal copolymer (X) and optionally further subjecting the spun copolymer to stretching.

As a core portion of the above-mentioned form [B] of a multilayer fiber having the surface coated with polyacetal copolymer (X), a fiber comprising a thermoplastic resin can be used. With respect to the type of the thermoplastic resin, there is no particular limitation, but examples of such thermoplastic resins include a polyacetal homopolymer, a polyacetal copolymer other than polyacetal copolymer (X) (for example, a polyacetal copolymer containing more than 5% by mole of the oxyalkylene unit(s) represented by the general formula (1), based on total moles of the oxymethylene unit(s) and oxyalkylene unit(s)), a polyolefin resin, a polylactic acid resin, a nylon resin, a polyester resin, a polyvinyl resin, and an elastomer thereof. These thermoplastic resins can be used alone or in combination of two or more types in such a form that they are stacked on one another or mixed with each other. The term "coated" used in the present invention means a form in which all of or part of the fiber plane surface parallel to the core fiber direction is covered. With respect to the percentage of coating of the surface, there is no particular limitation as long as it is in such a range that the $q_{max}$ value of the cloth can be at least 0.2 W/cm$^2$. However, the higher the percentage, the more desirable the contact cold sensation and colorfastness, and therefore it is recommendable that the percentage of coating of the surface is preferably at least 50 percent, more preferably at least 80 percent, further preferably at least 90 percent.

The multilayer fiber can be obtained by melt spinning polyacetal copolymer (X) and the above-mentioned thermoplastic resin, and optionally further subjecting the spun material to stretching. The obtained multilayer fiber has a form of a core/sheath structure in which all of or part of the thermoplastic resin core fiber is covered with polyacetal copolymer (X).

In the above-mentioned form [C] of a composite fiber having a surface of a fiber comprising a thermoplastic resin on which polyacetal copolymer (X) is exposed, the type of the thermoplastic resin is not particularly limited, and the same thermoplastic resins as those used in the above-mentioned form of a multilayer fiber can be used. One type of these thermoplastic resins can be used alone or in combination of two or more types of the thermoplastic resins in such a form that they are stacked on one another or mixed with each other.

The composite fiber having a surface of a fiber comprising a thermoplastic resin on which polyacetal copolymer (X) is exposed can be obtained by melt spinning a mixture of polyacetal copolymer (X) and the above-mentioned thermoplastic resin, and optionally further subjecting the spun mixture to stretching. The form of the obtained composite fiber may be in a state in which polyacetal copolymer (X) is mixed with the thermoplastic resin, a state in which polyacetal copolymer (X) and the thermoplastic resin constitute an "islands-in-a-sea" configuration or are in a dispersed state derived from the "islands-in-a-sea" configuration, or a state in which polyacetal copolymer (X) and the thermoplastic resin are present side by side in the surface. With respect to the percentage of exposure of polyacetal copolymer (X) on the surface of the composite fiber, there is no particular limitation as long as it is in such a range that the $q_{max}$ value of the cloth can be at least 0.2 W/cm$^2$. However, the higher the percentage, the more desirable the contact cold sensation and colorfastness, and therefore it is recommendable that the percentage of exposure of polyacetal copolymer (X) on the surface of the composite fiber is preferably at least 50 percent, more preferably at least 80 percent, further preferably at least 90 percent.

With respect to the fiber having polyacetal copolymer (X) on the surface used in the cloth of the present invention, preferred is a fiber in which the degree of orientation of molecular chains of polyacetal copolymer (X) is at least 75%, more preferred is a fiber in which the degree of orientation is at least 80%, and especially preferred is a fiber in which the degree of orientation is at least 90%, among the fibers of the above-mentioned forms. The reason for this is that the higher the degree of orientation, the more desirable the contact cold sensation and colorfastness of the cloth. The upper limit of the degree of orientation is not limited in view of the contact cold sensation and colorfastness. However, from the viewpoint of facilitating the production, preferred is a fiber in which the degree of orientation is 95% or less.

As discussed later, there is also a correlation between the contact cold sensation and colorfastness of the cloth of the present invention and the oxyalkylene unit(s) content of polyacetal copolymer (X). Further, the colorfastness of the cloth is also affected by the oxyalkylene unit(s) content of polyacetal copolymer (X) and the degree of orientation of molecular chains of polyacetal copolymer (X) in the fiber. For this reason, the above-mentioned degree of orientation is appropriately selected taking into consideration the level of the contact cold sensation, dyeing property, and colorfastness to be imparted to the cloth as well as the oxyalkylene unit(s) content of polyacetal copolymer (X). For example, polyacetal copolymer (X) having a large oxyalkylene unit(s) content tends to cause the contact cold sensation and colorfastness to be poor, but the larger the oxyalkylene unit(s) content of the polyacetal copolymer (X) the stronger the effect of the degree of orientation on the contact cold sensation and colorfastness. Therefore, by increasing the degree of orientation, it is possible to further improve the contact cold sensation and colorfastness. In this case, the dyeing property of the cloth tends to be poor when the degree of orientation is increased, and therefore the degree of orientation can be selected within the above-mentioned range taking into consideration the balance between the contact cold sensation, the colorfastness, and the dyeing property.

The degree of orientation for the fiber having polyacetal copolymer (X) on the surface used in the cloth of the present invention can be determined using a wide-angle X-ray diffractometer as described below in Examples of the present specification.

With respect to the single filament fineness of the fiber having polyacetal copolymer (X) on the surface used in the cloth of the present invention, an acceptable value varies depending on the use of the cloth and therefore there is no particular limitation. However, especially when used as a cloth which is to be in direct contact with a skin, for avoiding an adverse effect on the texture and feel of the cloth, the single filament fineness is preferably not more than 10 dtex (unit: decitex), more preferably not more than 5 dtex, further preferably not more than 2.5 dtex.

<Method for Producing the Fiber Constituting the Cloth of the Present Invention>

The fiber having polyacetal copolymer (X) on the surface used in the cloth of the present invention can be produced in accordance with any of the conventionally known methods for producing a fiber. For example, the fiber can be produced by melt spinning pellets of polyacetal copolymer (X). In this instance, from the viewpoint of increasing the degree of orientation, it is preferred that the melt spun fiber is further subjected to stretching. The stretching can be performed by any of the conventionally known methods and conditions. The draw ratio is preferably 3 times or more from the viewpoint of the degree of orientation. The upper limit of the draw ratio is not limited in view of the degree of orientation, but it is 15 times from the viewpoint of the stability during the production (preventing yarn breakage) and preventing excessive fibrillation. With respect to the apparatuses for melt spinning and stretching, any of those which are conventionally known can be used.

The shape of the cross-section of the fiber having polyacetal copolymer (X) on the surface used in the cloth of the present invention can be variously designed by selecting the shape of the nozzle spinneret used for melt spinning, but the shape of the cross-section is not particularly limited, and may be either a simple circular cross-section or a modified cross-section. Especially, when the fiber having a modified cross-section is used, it is possible to further improve the contact cold sensation.

<Polyacetal Copolymer (X)>

Polyacetal copolymer (X) in the fiber having polyacetal copolymer (X) on the surface used in the cloth of the present invention has in the molecule thereof an oxymethylene unit(s) (—$CH_2$—O—) as well as an oxyalkylene unit(s) of a structure represented by the following general formula (1):

[Chemical formula 2]

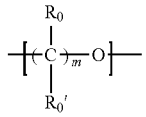

(1)

wherein each of $R_0$ and $R_0'$ represents a hydrogen atom, an alkyl group having 1 to 8 carbon atoms, an organic group having an alkyl group having 1 to 8 carbon atoms, a phenyl group, or an organic group having a phenyl group, and a plurality of $R_0$'s and $R_0$'s are the same or different, and m represents an integer of 2 to 6.

Examples of the alkyl groups having 1 to 8 carbon atoms include a methyl group, an ethyl group, a propyl group, an isopropyl group, a butyl group, an isobutyl group, a pentyl group, a hexyl group, and a cyclohexyl group. Examples of the organic groups having an alkyl group having 1 to 8 carbon atoms include alkoxy groups having 1 to 8 carbon atoms, such as a methoxy group, an ethoxy group, a propoxy group, an isopropoxy group, and a butoxy group. Examples of the organic groups having a phenyl group include a benzyl group and a phenethyl group.

With respect to the above-mentioned oxyalkylene unit(s), an oxyethylene group, an oxypropylene group, and an oxybutylene group are preferred, and an oxyethylene group is especially preferred.

One type of or two or more types of the above-mentioned oxyalkylene unit(s) may be contained in polyacetal copolymer (X). That is, polyacetal copolymer (X) in the present invention includes not only a bipolymer but also a multipolymer.

Further, as long as the $q_{max}$ value of the cloth can be at least 0.2 W/cm$^2$, polyacetal copolymer (X) in the present invention may be a polyacetal copolymer further having a block structure other than the oxymethylene unit(s) and oxyalkylene unit(s) or may be a polyacetal copolymer further having a branched structure in the molecule thereof. Examples of such polyacetal copolymers include a polyacetal copolymer having a structure derived from a chain transfer agent introduced in its terminals, the copolymer being obtained by using as a chain transfer agent a thermoplastic resin or oligomer having a functional group having active hydrogen, such as a hydroxyl group, in the end or middle of the molecule thereof; and a polyacetal copolymer which is obtained by conducting a polymerization reaction in the presence of a compound containing a copolymerizable cyclic formal site in the backbone thereof, such as polyvinyl formal.

Furthermore, as long as the $q_{max}$ value of the cloth can be at least 0.2 W/cm$^2$, polyacetal copolymer (X) in the present invention may be produced using as a termonomer, an epoxy compound, such as glycidyl ether, or allyl ether, for example; and it includes such a polyacetal copolymer having a structure derived from any of the above compounds.

Generally, the content of oxyalkylene unit(s) (mole of oxyalkylene unit(s)) in a polyacetal copolymer is in the wide range of from 0.01 to 20% by mole, but the content of oxyalkylene unit(s) (mole of oxyalkylene unit(s)) in polyacetal copolymer (X) in the present invention, based on total moles of the oxymethylene unit(s) and oxyalkylene unit(s), is 0.2 to 5.0% by mole, preferably 0.2 to 4.0% by mole, and especially preferably 1.0 to 4.0% by mole. When the oxyalkylene unit(s) content is at least 0.2% by mole, or not more than 5.0% by mole, the contact cold sensation and colorfastness are excellent. Especially, when the oxyalkylene unit(s) content is at least 0.2% by mole, or not more than 4.0% by mole, the contact cold sensation and colorfastness are especially excellent. As mentioned above, the contact cold sensation and colorfastness of the cloth of the present invention are affected by the oxyalkylene unit(s) content of polyacetal copolymer (X) and the degree of orientation of the fiber, and therefore the oxyalkylene unit(s) content of polyacetal copolymer (X) as well as the degree of orientation are appropriately selected within the above-mentioned ranges according to the desired use of the cloth. Especially, from the viewpoint of the contact cold sensation, a smaller oxyalkylene unit(s) content and a higher degree of orientation of the molecular chains of polyacetal copolymer (X) are preferable.

Particularly, with respect to the cloth of the present invention, the larger the oxyalkylene unit(s) content of polyacetal copolymer (X), the more desirable the dyeing property, and the smaller the oxyalkylene unit(s) content, the more desirable the colorfastness. Therefore, the oxyalkylene unit(s) content of polyacetal copolymer (X) is appropriately selected within the above-mentioned range of from 0.2 to 5.0% by mole according to the performance required for the use of the cloth. Especially, when the oxyalkylene unit(s) content of polyacetal copolymer (X) is at least 1.0% by mole, or not more than 4.0% by mole, the balance between the contact cold sensation, the dyeing property, and the colorfastness is especially excellent.

In the present invention, one polyacetal copolymer (X) may be used alone, two or more polyacetal copolymers (X) having different oxyalkylene units may be used in combination, or two or more polyacetal copolymers (X) having different oxyalkylene unit(s) contents may be used in combination. When two or more polyacetal copolymers (X) having different oxyalkylene units may be used in combination, or two or more polyacetal copolymers (X) having different oxyalkylene unit(s) contents are used in combination, they may be in a state in which the polyacetal copolymers are mixed with each another, a state in which the polyacetal copolymers constitute an "islands-in-a-sea" configuration or are in a dispersed state derived from the "islands-in-a-sea" configuration, or a state in which the polyacetal copolymers are present side by side.

Polyacetal copolymer (X) in the present invention preferably has an MVR (Melt Volume Rate) of not more than 100 cm$^3$/10 minutes, more preferably not more than 80 cm$^3$/10 minutes, especially preferably not more than 60 cm$^3$/10, as measured in accordance with ISO 1133. Although the polyacetal copolymer having a larger MVR value is more suitable for obtaining a thin fiber by melt spinning, the polyacetal copolymer having an MVR value of not more than 100 cm$^3$/10 minutes may give a fiber having excellent mechanical physical properties (particularly tenacity). With respect to the lower limit of the MVR value, there is no particular limitation. However, the polyacetal copolymer having a smaller the MVR value results in a higher melt viscosity upon melt spinning, as the result, the polyacetal copolymer cannot follow the change in shape, making it difficult to efficiently obtain a thin fiber. Therefore, the lower limit of the MVR value is preferably at least 3 cm$^3$/10 minutes, more preferably at least 8 cm$^3$/10 minutes for obtaining a thinner fiber.

<Method for Producing Polyacetal Copolymer (X)>

The method for producing polyacetal copolymer (X) in the present invention is not limited, and polyacetal copolymer (X) may be produced by any of the conventionally known methods. For example, with respect to the method for producing a polyacetal resin having oxymethylene unit(s) and oxyalkylene unit(s) having 2 to 4 carbon atoms as constituent units, the polyacetal resin can be produced by subjecting to copolymerization a cyclic acetal for oxymethylene unit(s), such as a trimer (trioxane) or a tetramer (tetraoxane) of formaldehyde, and a cyclic acetal containing oxyalkylene unit(s) having 2 to 4 carbon atoms, such as ethylene oxide, 1,3-dioxolane, 1,3,6-trioxocane, or 1,3-dioxepane. Especially, polyacetal copolymer (X) in the present invention is preferably a copolymer of a cyclic acetal, such as trioxane or tetraoxane, and ethylene oxide or 1,3-dioxolane, especially preferably a copolymer of trioxane and 1,3-dioxolane.

For example, polyacetal copolymer (X) in the present invention can be obtained by a method in which a cyclic acetal for oxymethylene unit(s) and a cyclic acetal comonomer containing oxyalkylene unit(s) having 2 to 4 carbon atoms are subjected to bulk polymerization using a polymerization catalyst. For the deactivation treatment of the polymerization catalyst and polymerization growth end, if necessary, a reaction terminator may be used. Further, for modifying the molecular weight of the polyacetal copolymer, if necessary, a molecular weight modifier may be used. With respect to the types and amounts of the polymerization catalyst, reaction terminator, and molecular weight modifier usable in the production of polyacetal copolymer (X) in the present invention, there is no particular limitation as long as the advantageous effects of the present invention are not adversely affected, and any of the conventionally known polymerization catalysts, reaction terminators, and molecular weight modifiers can be appropriately used.

With respect to the polymerization catalyst, there is no particular limitation, but examples of polymerization catalyst include Lewis acids, such as boron trifluoride, tin tetrachloride, titanium tetrachloride, phosphorus pentachloride, phosphorus pentafluoride, arsenic pentafluoride, and antimony pentafluoride; and complex compounds or salt compounds of the above Lewis acids. Further, the examples also include protonic acids, such as trifluoromethanesulfonic acid and perchloric acid; esters of a protonic acid, such as an ester of perchloric acid and a lower aliphatic alcohol; and anhydrides of a protonic acid, including a mixed acid anhydride of perchloric acid and a lower aliphatic carboxylic acid. The additional examples include triethyloxonium hexafluorophosphate, triphenylmethyl hexafluoroarsenate, acetyl hexafluoroborate, a heteropolyacid or an acid salt thereof, an isopolyacid or an acid salt thereof, and a perfluoroalkylsulfonic acid or an acid salt thereof. Of these, preferred are compounds containing boron trifluoride, and especially preferred are boron trifluoride diethyl etherate and boron trifluoride dibutyl etherate, which are a complex with an ether.

The amount of the polymerization catalyst used is not particularly limited, but is generally in the range of from $1.0\times10^{-8}$ to $2.0\times10^{-3}$ mol, preferably in the range of from $5.0\times10^{-8}$ to $8.0\times10^{-4}$ mol, especially preferably in the range of from $5.0\times10^{-8}$ to $1.0\times10^{-4}$ mol, per mol of the total of monomers (the sum of the trioxane and comonomers).

With respect to the reaction terminator, there is no particular limitation, but examples of reaction terminator include trivalent organophosphorus compounds, amine compounds, and hydroxides of an alkali metal or alkaline earth metal. These reaction terminators can be used alone or in combination. Of these, preferred are trivalent organophosphorus compounds, tertiary amines, and hindered amines.

With respect to the amount of the reaction terminator used, there is no particular limitation as long as the amount is sufficient to deactivate the polymerization catalyst, but the amount of the reaction terminator is generally in the range of from $1.0\times10^{-1}$ to $1.0\times10^{1}$, in terms of a molar ratio of the reaction terminator to the polymerization catalyst.

With respect to the molecular weight modifier, there is no particular limitation, but examples of molecular weight modifier include methylal, methoxymethylal, dimethoxymethylal, trimethoxymethylal, and oxymethylene di-n-butyl ether. Of these, methylal is preferred. The amount of the molecular weight modifier used is appropriately determined according to the intended molecular weight. Usually, the amount of the molecular weight modifier added is adjusted in the range of from 0 to 0.1% by mass, based on the mass of the all monomers.

<Optional Components and Other Components which May be Added to Polyacetal Copolymer (X)>

Further, when practicing the present invention, a hindered phenol compound, a hindered amine compound, an amino-substituted triazine compound, a phosphorus stabilizer, a metal-containing compound indicated by the group consisting of a hydroxide, fatty acid salt, inorganic acid salt, and alkoxide of an alkali metal or alkaline earth metal can be added to polyacetal copolymer (X) in the present invention, provided that the intended purpose of the present invention is not adversely affected. Hereinafter, in the present specification, the above-mentioned "a hindered phenol compound, a hindered amine compound, an amino-substituted triazine compound, a phosphorus stabilizer, and a metal-containing compound indicated by the group consisting of a hydroxide, fatty acid salt, inorganic acid salt, and alkoxide of an alkali metal or alkaline earth metal" is frequently referred to as "optional component". With respect to the optional component, those which are conventionally known can be used.

Further, when practicing the present invention, in addition to the above-mentioned optional components, if necessary, various additives, such as a stabilizer, a nucleating agent, a release agent, a filler, a pigment, a dye, a lubricant, a plasticizer, an antistatic agent, an oil, a size, a sizing agent, an ultraviolet light absorber, a flame retardant, and a flame retardant auxiliary, or other thermoplastic resins or elastomers may be appropriately added to polyacetal copolymer (X) in the present invention, provided that the intended purpose of the present invention is not adversely affected. Hereinafter, in the present specification, the above-mentioned "various additives, such as a stabilizer, a nucleating agent, a release agent, a filler, a pigment, a dye, a lubricant, a plasticizer, an antistatic agent, an oil, a size, an ultraviolet light absorber, a flame retardant, and a flame retardant auxiliary, or other resins or elastomers" are frequently referred to as "other components". Examples of fillers include mineral fillers, such as glass flakes, glass beads, wollastonite, mica, talc, boron nitride, calcium carbonate, kaolin, silicon dioxide, clay, silica, diatomaceous earth, graphite, and molybdenum disulfide, carbon black, and a pigment.

With respect to the method for adding the above-mentioned optional components or other components to polyacetal copolymer (X), there is no particular limitation, and, for example, the production thereof can be carried out by mixing and kneading the above-mentioned polyacetal copolymer (X) with optional components and/or other components as occasion demands in an arbitrary order. The conditions for mixing and kneading, such as the temperature and pressure for the mixing and kneading, may be appropriately selected according to any of the conventionally known methods for producing a polyacetal copolymer. For example, kneading may be conducted at or higher than the melting temperature of the polyacetal copolymer, and it is preferably conducted usually at least 180° C. and not higher than 260° C. With respect to the apparatus for producing the polyacetal copolymer, there is no particular limitation, and, for example, a mixing or kneading apparatus conventionally used for producing a polyacetal copolymer of this type can be used. The above-mentioned optional components or other components may be separately mixed into, or allowed to penetrate into or adsorb on, or deposited on a fiber containing polyacetal copolymer (X).

<Type of the Cloth>

In the present invention, the cloth indicates a primary processed article in a sheet form obtained by weaving or knitting a fiber. Specifically, there can be mentioned a form of a woven cloth obtained by combining a warp yarn and a weft yarn at a right angle into the shape of a plane having a certain width and thickness, and a form of a knitted cloth obtained by connecting together loops into the shape of a plane; and forms of a braid, a lace, and a felt are also included. A form of nonwoven fabric is not included. Particularly, the form of a woven cloth or knitted cloth is preferred, because the properties of contact cold sensation and colorfastness can be satisfactorily exhibited.

The cloth of the present invention having excellent contact cold sensation and colorfastness comprises at least the above-mentioned fiber having on the surface polyacetal copolymer (X) containing oxyalkylene unit(s) in a specific amount. Specifically, the cloth of the present invention may be a cloth obtained from only the above-mentioned fiber having on the surface polyacetal copolymer (X) containing oxyalkylene unit(s) in a specific amount, and may be a cloth obtained from the above-mentioned fiber having on the surface polyacetal copolymer (X) containing oxyalkylene unit(s) in a specific amount and another fiber other than the above-mentioned fiber having on the surface polyacetal copolymer (X) containing oxyalkylene unit(s) in a specific amount (hereinafter, referred to as "another fiber"). Of these, a cloth obtained from only the above-mentioned fiber having on the surface polyacetal copolymer (X) containing oxyalkylene unit(s) in a specific amount is preferred from the viewpoint of excellent contact cold sensation.

With respect to the above-mentioned "another fiber", there is no particular limitation as long as it is other than the above-mentioned fiber having on the surface polyacetal copolymer (X) containing oxyalkylene unit(s) in a specific amount, but examples of such fibers include synthetic fibers, such as nylon, polyester, and polyurethane, and natural fibers, such as cotton, linen, and silk. The shape of the cross-section of another fiber can be variously designed by selecting the shape of the nozzle spinneret used for melt spinning, but is not particularly limited, and may be either a simple circular cross-section or a modified cross-section. Especially, when the fiber having a modified cross-section is used, it is possible to further improve the contact cold sensation.

Further, the cloth of the present invention having excellent contact cold sensation and colorfastness may be a cloth obtained using a twisted yarn or covered yarn which is formed by combining together the above-mentioned fiber having on the surface polyacetal copolymer (X) containing oxyalkylene unit(s) in a specific amount and a synthetic fiber, such as nylon, polyester, or polyurethane, or a natural fiber, such as cotton, linen, or silk. Furthermore, the cloth of the present invention may be a cloth obtained by combining or blending the above-mentioned fiber having on the surface polyacetal copolymer (X) containing oxyalkylene unit(s) in a specific amount and a synthetic fiber, such as nylon, polyester, or polyurethane, or a natural fiber, such as cotton, linen, or silk.

<Method for Producing the Cloth>

With respect to the method for producing the cloth of the present invention, there is no particular limitation, and a generally known method can be used. For example, there can be used a general method for producing a cloth, which is used in the production of the above-mentioned woven cloth obtained by combining a warp yarn and a weft yarn at a right angle into the shape of a plane having a certain width and thickness, knitted cloth obtained by connecting together loops into the shape of a plane, lace, braid, or felt. Further, when the cloth is a woven cloth or a knitted cloth, the way of weaving or knitting for the cloth is not particularly limited, and the woven cloth may be, for example, in a plain woven, twill woven, satin woven, mat woven, or designed woven form. The knitted cloth may be in a warp knitted or weft knitted form, or, for example, in a plain knitted, rib knitted, interlock knitted, or purl knitted form.

<Application of the Cloth>

The cloth of the present invention having excellent contact cold sensation and colorfastness can be further processed into various types of cloth products (fabricated articles). Differing from clothes obtained by adding an additive having an effect of contact cold sensation or colorfastness or a surface treatment agent to a fiber or cloth, or from those obtained by surface-treating a fiber or cloth with such an additive or agent, the cloth of the present invention inherently has excellent resistance to washing, and therefore can be advantageously used as a raw material for various types of cloth products. Particularly, the cloth of the present invention can be advantageously used as underwear, such as underclothes, outerwear, such as sportswear, pants, and a skirt, clothing articles, such as a shirt, nightwear, pantyhose, and stockings, bedding articles, such as a sheet, a bedding quilt (futon) cover, and a pillow cover, interior articles, such, as a mat, a curtain, and a carpet, daily miscellaneous items, such as a handkerchief and a towel, and interior automotive trims, such as a seat and a seat cover.

<Contact Cold Sensation and $q_{max}$ Value>

The contact cold sensation in the present invention is an index for a functional test, indicating whether the coolness of a cloth is felt or not when the cloth touches the skin, and, generally, the contact cold sensation has a correlation with the $q_{max}$ value. That is, there is a tendency that the larger the $q_{max}$ value, the more desirable the contact cold sensation, or the smaller the $q_{max}$ value, the poorer the contact cold sensation. When used as fabric, the cloth of the present invention having excellent contact cold sensation may provide us with satisfactory coolness at functional test level. That is, when wearing a clothing article formed from the cloth of the present invention, the clothing article may give almost all humans contact cold sensation, making it possible to give them a sensation of coolness.

In the present invention, the cloth having excellent contact cold sensation is a cloth which exhibits a $q_{max}$ value of at least 0.2 W/cm$^2$, in which the $q_{max}$ value indicates a maximum in a heat flux curve obtained by plotting, relative to time t, a heat flux q (t) per unit area which transfers from a heat storing plate of 40° C. to the cloth, when the cloth is brought into contact with the heat storing plate under a contact pressure of 0.098 N/cm$^2$ in an environment at a temperature of 20° C. and at a relative humidity of 65%. Heat flux q (t) shows a peak value immediately after the cloth is brought into contact with the heat storing plate (usually within an hour), and subsequently slowly decreases. This peak value is called an initial heat flux maximum $q_{max}$, and considered as an objective value for evaluation of the feeling of coolness or warmth with respect to a cloth. When the $q_{max}$ value is at least 0.2 W/cm$^2$, the above-mentioned contact cold sensation is excellent. The reason for this is that the above $q_{max}$ value is larger than the $q_{max}$ value of a cloth comprising a polyester (PET) fiber which is generally widely used in clothing and others. Further, when the $q_{max}$ value is at least 0.3 W/cm$^2$, the contact cold sensation is advantageously especially excellent. The $q_{max}$ value can be measured by the general method described in Examples. The $q_{max}$ value tends to become better as the content of the oxyalkylene unit(s) in polyacetal copolymer (X) decreases. From the viewpoint of the $q_{max}$ value, the content of the oxyalkylene unit(s) in polyacetal copolymer (X) in the fiber in the present invention is preferably not more than 5% by mole, especially preferably not more than 3% by mole. Further, the $q_{max}$ value tends to become better as the degree of orientation of molecular chains of polyacetal copolymer (X) increases. From the viewpoint of the $q_{max}$ value, the degree of orientation of the molecular chains is preferably at least 75%, more preferably at least 80%, especially preferably at least 90%.

<Dyeing Property and Colorfastness>

The dyeing property in the present invention is an index indicating easiness for dyeing a cloth. Dyeing refers to coloring a cloth with a desired color or pattern utilizing the dyeing power of a dye. The dyeing property is an index indicating the strength of soaking property or dyeing power of a dye for a cloth, and, when the soaking property or dyeing power of a dye is strong, a cloth is colored with a color close to the dye, so that excellent dyeing property can be achieved. Conversely, when the soaking property or dyeing power of a dye is weak, a cloth can be colored only with a color lighter than the dye. As a dye, any known dye, such as a disperse dye, an acid dye, a cationic dye, a reactive dye, or a direct dye, can be used. From the viewpoint of the dyeing property and the below-mentioned colorfastness, a disperse dye is preferred. Dyeing may be performed for a yarn in the stage before being formed into a cloth. On the other hand, the colorfastness is an index indicating a fastness (resistance) of the color of a cloth dyed with a dye, i.e., the so-called "resistance to color change", representatively "resistance to fading", and is evaluated in terms of the extent of "change in color" and "staining". The treatment made upon measuring the colorfastness includes exposure to daylight, washing, sweat, crocking, an acid, or ironing. The colorfastness is determined as a grade for the value of change in color or staining, which is obtained by comparing a test specimen before and after the treatment by visual observation or a method using a machine. Generally, a cloth having excellent dyeing property and excellent colorfastness is advantageous, because the degree of freedom of the use of the cloth is widened in view of dyeing. For example, a cloth having a larger value of the grade as measured in accordance with A-2 method of JIS L0844 "Test method for colorfastness to washing" is advantageous, because the degree of freedom of the use of the cloth is widened in view of dyeing.

<Quick Drying Property>

The quick drying property of a cloth in the present invention is an index for property of a cloth indicating how quickly the cloth containing water is dried. A cloth capable of being dried faster than a cloth comprising a polyester (PET) fiber, which has generally been known to have excellent quick drying property, is advantageous, because such a cloth gives a sensation of coolness and is more likely to allow us to feel cool when used in the applications of, e.g., underclothes and bedclothes that are to be in contact with the human skin. The reason for this is presumed that latent heat is lost by the evaporation of water absorbed by the fiber from the skin. The quick drying property can be measured by the method described in Examples. When the rate of drying of a cloth comprising a PET fiber is taken as a reference (1.0), the quick drying property is preferably 0.9 or less, more preferably 0.8 or less. The quick drying property tends to become better as the content of the oxyalkylene unit(s) in polyacetal copolymer (X) decreases. From the viewpoint of the quick drying property, the content of the oxyalkylene unit(s) in polyacetal copolymer (X) in the fiber in the present invention is preferably not more than 5% by mole, especially preferably not more than 2% by mole. Further, the quick drying property tends to become better as the degree of orientation of molecular chains of polyacetal copolymer (X) increases. From the viewpoint of the quick drying property, the degree of orientation is preferably at least 75%, more preferably at least 80%, especially preferably at least 90%.

<Gloss>

The gloss of a cloth in the present invention is an index indicating the degree of brightness of a cloth when the surface of the cloth receives a light. The larger the value of gloss, the smoother and gloss the surface of the cloth, so that a luxurious appearance can be imparted to the cloth. The gloss can be measured by the method for measuring a reflectance of a visible light described in Examples. When the gloss of a cloth comprising a PET fiber is taken as a reference (1.0), the gloss in the present invention is preferably at least 1.1, more preferably at least 1.2. The gloss tends to be excellent when the content of the oxyalkylene unit(s) in polyacetal copolymer (X) is not more than 5% by mole, and therefore the content of the oxyalkylene unit(s) in polyacetal copolymer (X) in the fiber in the present invention is preferably not more than 5% by mole.

EXAMPLES

Hereinbelow, the embodiments and effects of the present invention will be described in more detail with reference to the following Examples and Comparative Examples, which should not be construed as limiting the scope of the present invention.

<Polyacetal Copolymer (X)>

Polyacetal copolymers (X) used in Examples and Comparative Examples are as follows. The oxyethylene group content of polyacetal copolymer (X) (percentage by mole of the oxyethylene group) is a value relative to the total moles of the oxymethylene unit(s) and the oxyethylene group.

POM-1: Polyacetal copolymer having an oxyethylene group content of 0.4% by mole and an MVR of 15.

POM-2: Polyacetal copolymer having an oxyethylene group content of 1.6% by mole and an MVR of 15.

POM-3: Polyacetal copolymer having an oxyethylene group content of 3.0% by mole and an MVR of 15.

POM-4: Polyacetal copolymer having an oxyethylene group content of 4.7% by mole and an MVR of 15.

POM-5: Polyacetal copolymer having an oxyethylene group content of 5.7% by mole and an MVR of 15.

<Measurement of MVR>

The MVR of polyacetal copolymer (X) was measured in accordance with ISO 1133.

<Measurement of the Content of the Oxyethylene Group in Polyacetal Copolymer (X)>

Each of the polyacetal copolymers used in Examples and Comparative Examples was dissolved in hexafluoroisopropanol (d2) to prepare a sample for NMR measurement. The NMR spectrum was measured for the prepared sample to determine the content of the oxyethylene group in the polyacetal copolymer.

<Preparation of Polyacetal Copolymer Fiber>

The polyacetal copolymer fiber for producing the cloths used in Examples and Comparative Examples was prepared as follows. The temperature of a cylinder and a nozzle portion was raised to 200° C., and a molten resin was discharged from the nozzle having 36 holes each having a diameter of 0.6 mm at a rate of 0.8 to 1.2 kg/h, whereupon an unstretched fiber was continuously taken at a take-up rate of about 200 to 400 m/minute. The obtained unstretched fiber was subsequently introduced to a heat stretching step and subjected to stretching treatment at a roll temperature of 120 to 140° C. to yield a fiber sample. In the case of a core/sheath composite fiber, the injection rate from the nozzle was 0.4 kg/h for both of the resin for core component and the resin for sheath component.

<Other Thermoplastic Resin>

PET (polyethylene terephthalate resin): A multifilament having a single filament fineness of 2 dtex was used as such.

<Measurement of the Fineness of Fiber>

With respect to the fineness [dtex (decitex)] of a fiber, the fiber diameter of a single filament was measured using an optical microscope, the fineness was calculated from the density of the fiber, and the average of the fineness values measured for 50 fibers was taken as the fineness of the fiber. In the case of a single-layer fiber of the polyacetal copolymer, the density of the fiber was 1.40 g/cm$^3$. In the case of a multilayer fiber, the density of the fiber was a weighted average of the density of the constituent materials. In the case of a single-layer fiber of PET, the density of the fiber was 1.37 g/cm$^3$.

<Measurement of the Degree of Orientation Fc (%) of Fiber>

Using a wide-angle X-ray diffractometer (DP-D 1, manufactured by Shimadzu Corporation), and using CuKα (using a Ni filter) as a source of a ray, measurement was made (power: 45 KV; 40 mA). The degree of orientation (fc) of molecular chains was determined using formula (1) below from a half band width FWHM (°) of a distribution curve of a diffraction intensity (azimuth distribution curve) obtained by scanning in the circumferential direction with respect to the (100) crystal plane observed in the vicinity of 2θ=22.2°.

[Equation 1]

$$fc(\%)=((180°-FWHM)/180°)\times 100 \quad \text{Formula(1)}$$

<Preparation of a Cloth>

Of the cloths used in Examples and Comparative Examples, the cloths obtained by knitting were those knitted with 44 wales/inch and 40 courses/inch using the fiber having a polyacetal copolymer on the surface prepared by the above-mentioned method or a PET fiber. The wale of the cloth obtained by knitting is expressed by the number of loop-form stitches per inch counted in the weft direction, and the course is expressed by the number of loop-form stitches per inch counted in the warp direction. The density of the cloths obtained by knitting varies depending on these numbers.

Using the single-layer fiber comprising a polyacetal copolymer prepared by the above-mentioned method, a crimped yarn having a length of 64 mm was prepared, and treated using a carding machine. The obtained web was subjected to needle punching treatment to prepare nonwoven fabric.

All the obtained cloths have a weight per unit area of about 200 g/m$^2$.

<Measurement of a $q_{max}$ Value of a Cloth>

The cloth in Example or Comparative Example was placed on a sample holder set at a temperature of 20° C. and a relative humidity of 65%. A heat storing plate (pure copper plate) heated to a temperature of 40° C. was put on the cloth at a contact pressure of 0.098 N/cm$^2$. From the time immediately after this, the quantity of heat transferred from the heat storing plate to the cloth sample on the lower temperature side was measured. The $q_{max}$ value was determined from the maximum in a heat flux curve obtained by plotting heat flux q (t) per unit area relative to time t. The quantity of transferred heat was measured using Thermo Labo II Precise and Fast Thermal Property-Measuring Instrument (manufactured by Kato Tech Co., Ltd.). The larger the $q_{max}$ value, the faster the transfer rate of heat, and the more desirable the contact cold sensation of the cloth.

<Measurement of Quick Drying Property (Residual Water Content)>

A cloth having a size of 10 cm×10 cm was impregnated with 0.6 g of water. The resultant cloth was allowed to stand in a suspended state in an environment at a temperature of 20° C. and at a relative humidity of 65%. The mass of the suspended cloth was measured at intervals of predetermined time, and the residual water amount in the cloth was calculated to determine the residual water content (unit: % by mass). The period of time (minute) until the residual water content reached 10% by mass was taken as the index of quick drying property. The shorter the period of time, the more desirable the quick drying property.

<Measurement of Gloss (Visible Light Reflectance)>

Using an ultraviolet-visible-near infrared spectrophotometer UV-3600 (integrating sphere: ISR-3100), manufactured by Shimadzu Corporation, a visible light reflectance was determined, in terms of a reflectance of a light in the measurement wavelength range of from 400 to 780 nm. The larger the visible light reflectance, the higher the gloss.

<Test for Contact Cold Sensation>

The feel obtained when touching each of the cloths in Examples and Comparative Examples was evaluated in accordance with the following three criteria: ⊙ (excellent); ○ (good); and x (unacceptable).

<Test for Dyeing Property and Colorfastness>

Using an anthraquinone disperse dye, each of the cloths in Examples and Comparative Examples was dyed blue with 0.2% omf (omf: an abbreviation of "on the mass of fiber", which indicates the amount of the dye deposited on a fiber). Each of the dyed cloths was visually compared in density, and evaluated in accordance with the four criteria of from 1 to 4. Numeral 4 indicates that the cloth has a satisfactory density, and numerals 3, 2, and 1 indicate that the density is diminished in this order. The results of the evaluation are shown in Table 1. The larger the numeral, the more desirable the dyeing property, and numeral 1 means poor dyeing property. Then, with respect to these cloths, the fastness was evaluated in accordance with A-2 method of JIS L0844 "Test method for colorfastness to washing", in terms of the "grade" expressed as grades 1 to 5. The larger the value, the more desirable the colorfastness.

Examples and Comparative Examples

Table 1 shows Examples, which relate to: cloths prepared using a single-layer fiber of a polyacetal copolymer having an oxyethylene group content in the predetermined range, a cloth prepared using a multilayer fiber of a polyacetal copolymer having an oxyethylene group content in the predetermined range, and a cloth prepared using a multilayer fiber of a polyacetal copolymer having an oxyethylene group content in the predetermined range and a polylactic acid resin (PLA); as well as Comparative Examples, which relate to: a cloth prepared using a PET fiber, a cloth prepared using a single-layer fiber of a polyacetal copolymer having an oxyethylene group content larger than the predetermined range, and nonwoven fabric prepared using a single-layer fiber of a polyacetal copolymer.

TABLE 1

| | | Example 1 | Example 2 | Example 3 | Example 4 | Example 5 | Example 6 |
|---|---|---|---|---|---|---|---|
| Raw material for fiber | | POM-1 | POM-2 | POM-3 | POM-4 | POM-4 | POM-1 (core)/ POM-4 (sheath) |
| Oxyethylene group content of polyacetal copolymer [mol %] | | 0.4 | 1.6 | 3.0 | 4.7 | 4.7 | 0.4/4.7 |
| Single fiber fineness [dtex] | | 2.3 | 2.3 | 2.3 | 2.3 | 2.3 | 2.3 |
| Degree of orientation of fiber [%] | | 87 | 84 | 84 | 82 | 93 | 85 |
| Evaluation of cloth | Form | Knitted | Knitted | Knitted | Knitted | Knitted | Knitted |
| | qmax[W/cm$^2$] | 0.32 | 0.33 | 0.32 | 0.30 | 0.33 | 0.31 |
| | Cool feel test | ◎ | ◎ | ◎ | ○ | ◎ | ○ |
| | Quick drying property [min.] | 39 | 41 | 43 | 46 | 43 | 42 |
| | Gloss (visible light reflectance) [%] | 60 | 61 | 60 | 61 | 62 | 61 |
| | Dyeing property test | 2 | 3 | 4 | 4 | 4 | 4 |
| | Colorfastness test: Change in color [Grade] | 3-4 | 3-4 | 3 | 2 | 2-3 | 2-3 |

| | | Example 7 | Comparative Example 1 | Comparative Example 2 | Comparative Example 3 |
|---|---|---|---|---|---|
| Raw material for fiber | | PLA (core)/ POM-4 (sheath) | PET | POM-5 | POM-2 |
| Oxyethylene group content of polyacetal copolymer [mol %] | | —/4.7 | — | 5.7 | 1.6 |
| Single fiber fineness [dtex] | | 2.3 | 2.3 | 12 | 2.3 |
| Degree of orientation of fiber [%] | | 84 | — | 72 | 84 |
| Evaluation of cloth | Form | Knitted | Knitted | Knitted | Nonwoven fabric |
| | qmax[W/cm$^2$] | 0.31 | 0.19 | 0.19 | 0.15 |
| | Cool feel test | ○ | X | X | X |
| | Quick drying property [min.] | 44 | 52 | 56 | 51 |
| | Gloss (visible light reflectance) [%] | 58 | 50 | 47 | 23 |
| | Dyeing property test | 4 | — | 4 | 3 |
| | Colorfastness test: Change in color [Grade] | 2-3 | — | 1 | 3-4 |

Examples 1 to 7 demonstrate that, having a $q_{max}$ value of at least 0.2 W/cm$^2$, the cloths prepared using a single-layer fiber of a polyacetal copolymer having an oxyalkylene unit(s) content in the predetermined range, the cloth prepared using a multilayer fiber of a polyacetal copolymer having an oxyalkylene unit(s) content in the predetermined range, and the cloth prepared using a multilayer fiber of a polyacetal copolymer having an oxyalkylene unit(s) content in the predetermined range and PLA provide excellent contact cold sensation and excellent colorfastness. Further, Examples 4 and 5 demonstrate that, between the cloths having the same alkylene group content, the higher the degree of orientation of the fiber, the more desirable the contact cold sensation and colorfastness.

The invention claimed is:

1. A cloth comprising a fiber having on a surface a polyacetal copolymer (X) comprising oxymethylene unit(s) and oxyalkylene unit(s) represented by the general formula (1) below, wherein the polyacetal copolymer (X) contains 0.2 to 5.0% by mole of the oxyalkylene unit(s), based on total moles of the oxymethylene unit(s) and oxyalkylene unit(s), and wherein the cloth exhibits a $q_{max}$ value of at least 0.2 W/cm$^2$, in which the $q_{max}$ value indicates a maximum in a heat flux curve obtained by plotting, relative to time t, a heat flux q (t) per unit area which transfers from a heat storing plate of 40° C. to the cloth, when the cloth is brought into contact with the heat storing plate under a contact pressure of 0.098 N/cm$^2$ in an environment at a temperature of 20° C. and at a relative humidity of 65%:

(1)

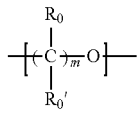

wherein each of $R_0$ and $R_0$' represents a hydrogen atom, an alkyl group having 1 to 8 carbon atoms, an organic group having an alkyl group having 1 to 8 carbon atoms, a phenyl group, or an organic group having a phenyl group, and a plurality of $R_0$'s and $R_0$'s are the same or different, and m represents an integer of 2 to 6.

2. The cloth according to claim 1, wherein the polyacetal copolymer (X) has a degree of orientation of molecular chains of 75 to 95%.

3. The cloth according to claim 1, wherein the fiber having on a surface a polyacetal copolymer (X) is a single-layer fiber of the polyacetal copolymer (X).

4. The cloth according to claim 1, wherein the fiber having on a surface a polyacetal copolymer (X) is a multilayer fiber, in which a fiber comprising a thermoplastic resin is coated with the polyacetal copolymer (X).

5. The cloth according to claim 1, wherein the fiber having on a surface a polyacetal copolymer (X) is a composite fiber having the polyacetal copolymer (X) on a surface of a fiber comprising a thermoplastic resin.

6. The cloth according to claim 4, wherein the thermoplastic resin is at least one member selected from a polyacetal homopolymer, a polyacetal copolymer other than the polyacetal copolymer (X), a polyolefin resin, a polylactic acid resin, a nylon resin, a polyester resin, a polyvinyl resin, and an elastomer thereof.

7. A clothing article from the cloth according to claim 1.

8. A bedding article from the cloth according to claim 1.

9. An interior article from the cloth according to claim 1.

10. An interior automotive trim from the cloth according to claim 1.

* * * * *